United States Patent [19]

Tosaka et al.

[11] Patent Number: 4,931,106

[45] Date of Patent: Jun. 5, 1990

[54] HOT ROLLED STEEL SHEET HAVING HIGH RESISTANCES AGAINST SECONDARY-WORK EMBRITTLEMENT AND BRAZING EMBRITTLEMENT AND ADAPTED FOR ULTRA-DEEP DRAWING AND A METHOD FOR PRODUCING THE SAME

[75] Inventors: Akio Tosaka; Kei Sakata; Koichi Hashiguchi, all of Chiba; Tateo Higashino, Kurashiki; Toshio Ichida, Chiba, all of Japan

[73] Assignee: Kawasaki Steel Corporation, Japan

[21] Appl. No.: 241,386

[22] Filed: Sep. 7, 1988

[30] Foreign Application Priority Data

Sep. 14, 1987 [JP] Japan ..... 62-228570
Jun. 10, 1988 [JP] Japan ..... 63-141846

[51] Int. Cl.[5] ..... C22C 38/14; C21D 8/04

[52] U.S. Cl. ..... 148/12 C; 148/12 F; 148/330; 148/320

[58] Field of Search ..... 148/12 C, 12 F, 330, 148/320; 420/126, 121

[56] References Cited

U.S. PATENT DOCUMENTS 4,769,088 9/1988 Itami et al. ..... 148/12 F

FOREIGN PATENT DOCUMENTS 0171208 2/1986 European Pat. Off. .
0203809 12/1986 European Pat. Off. .
0231862 8/1987 European Pat. Off. .
54-12883 5/1979 Japan .
54-14563 6/1979 Japan .
54-26974 9/1979 Japan .
56-142852 11/1981 Japan .
59-140333 8/1984 Japan .
59-229413 12/1984 Japan ..... 148/12 C
61-295324 12/1986 Japan ..... 148/12 F

*Primary Examiner*—Deborah Yee
*Attorney, Agent, or Firm*—Arnold, White & Durkee

[57] ABSTRACT

A hot rolled steel sheet having a specific composition and having a specific small grain size of ferrite constituting the steel sheet has high resistances against secondary-work embrittlement and brazing embrittlement and is adapted for ultra-deep drawing. The specific small grain size of the ferrite can be obtained by limiting the hot rolling condition of a slab having the specific composition.

3 Claims, 2 Drawing Sheets

HOT ROLLED STEEL SHEET HAVING HIGH RESISTANCES AGAINST SECONDARY-WORK EMBRITTLEMENT AND BRAZING EMBRITTLEMENT AND ADAPTED FOR ULTRA-DEEP DRAWING AND A METHOD FOR PRODUCING THE SAME

BACKGROUND OF THE INVENTION (1) Field of the Invention:

The present invention relates to a hot rolled steel sheet adapted for ultra-deep drawing, and more particularly relates to a hot rolled steel sheet having high resistances against secondary-work embrittlement and brazing embrittlement and adapted for ultra-deep drawing, and a method for producing the hot rolled steel sheet through a hot rolling step which can surely and stably form a ferrite texture effective for improving these properties.

(2) Related Art Statement:

A hot rolled steel sheet to be used in a part, such as a compressor cover for air-conditioning apparatus or the like, which is demanded to have an ultra-deep drawability, must be high in resistance against embrittlement under an impact load at low temperature after the hot rolled steel sheet has been subjected to a primary working, such as drawing or like, that is, must be high in resistance against secondary-work embrittlement. Moreover, when the hot rolled steel sheet, after having been subjected to a primary working or subjected to a secondary working following the primary working, is subjected to a brazing treatment, the primarily or secondarily worked steel sheet is required not to crack due to the brazing embrittlement, that is, required to have a high resistance against brazing embrittlement.

There have hitherto been known, as a hot rolled steel sheet for deep drawing, a hot rolled steel sheet produced from an A killed steel or rimmed steel, each having a low carbon content (C: 0.02–0.07% by weight; hereinafter, "% by weight" is represented by merely "%"), through a hot rolling following by a coiling at high temperature, and a soft hot rolled steel sheet produced from a steel having an ultra-low C content (C: $<0.01\%$) and containing B or Nb, which is added to the steel in order to make soft the resulting hot rolled steel sheet. Recently, Japanese Pat. Application Publication No. 60-7,690 has disclosed a hot rolled steel sheet, which is produced from a low carbon rimmed steel having a C content of not higher than 0.10% and having an available Mn content limited to at least 0.10%, said available Mn content being a remainder after consumed in the form of oxide and sulfide, by subjecting a slab of the steel to a particular treatment of a combination of a low temperature heating (1,050°–1,200° C.) and a low temperature rolling (700°–800° C.).

In general, in the hot rolled steel sheet, the development of {111} recrystallization texture, which is effective for deep drawability, is difficult contrary to that in the cold rolled steel sheet, and the $\bar{r}$ value of a measure of deep drawability is about 1.0 at the highest (in the cold rolled steel sheet, the $\bar{r}$ value is generally about 1.3–2.2). However, the hot rolled steel sheet has a large thickness, and hence the sheet can be drawn more advantageously due to its large thickness inspite of its low $\bar{r}$ value than the cold rolled steel sheet.

Therefore, in the hot rolled steel sheet, it is rather important that the sheet has a low $\Delta r$ value of the planar anisotropy relating to r value, and further the ductility of the sheet is more important than the low $\Delta r$ value. That is, in the hot rolled steel sheet, the low $\bar{r}$ value can be compensated by the excellent ductility.

It is known that the hot rolled steel sheet embrittles noticeably after workings, such as drawing and the like, which are accompanied with shrinkage or flange deformation, and therefore it is an important requirement for the hot rolled steel sheet not to crack by the impact load after the primary working, that is, to be high in the resistance against the secondary-work embrittlement.

The hot rolled steel sheet is often used as a material for a vessel. In this case, the hot rolled steel sheet is subjected to various workings after the deep drawing. Brazing is one of such workings, which have a serious influence upon the property of the steel sheet.

Brazing is a simple method and is used fairly widely due to its excellent airtightness. However, when the hot rolled steel sheet is brazed under a state that a high residual tensile load still remains in the sheet, the sheet has a risk of being cracked due to the "brazing embrittlement". Therefore, the hot rolled steel sheet is often subjected to a stress relief annealing before the brazing of the sheet. However, it results in an increase of treating steps to carry out the stress relief annealing before the brazing, and hence such procedure is not preferable.

Accordingly, it is an important property demanded of the hot rolled steel sheet that the sheet has such a high resistance against brazing embrittlement that the sheet can be easily subjected to a secondary working or a brazing working without carrying out the stress relief annealing after the deep drawing.

The properties demanded to the hot rolled steel sheet for ultra-deep drawing are as follows.

(1) The sheet has a high ductility.

(2) The sheet has a low stress at the yield point.

(3) It is desirable that the sheet has a high tensile strength while keeping its ductility.

(4) The sheet is free from cracks during the drawing or cracks due to the impact after the drawing, that is, the sheet is high in the resistance against secondary-work embrittlement.

(5) The sheet is free from cracks in the secondary working, welding, brazing and the like carried out after the drawing, that is, the sheet is free from the deterioration of the resistance against secondary-work embrittlement and has high resistance against brazing embrittlement.

The object of the present invention is to provide a hot rolled steel sheet having all of the above described properties, and a method for producing the steel sheet.

The inventors have investigated with respect to the composition of a steel which can produce a hot rolled steel sheet having the above described various properties, and found out the following facts. In order to solve the requirements of the above described items (1) and (2), an ultra-low C steel containing Ti is used. Moreover, in order to solve the requirement of item (2), S is contained in the ultra-low C steel in an amount lower than the ordinary level (S=0.005–0.015%), and further the content of Ti is limited depending upon the amounts of C, N and S. In order to solve the requirement of item (3), B is contained in a steel, and the coiling temperature following the hot rolling of the B-containing steel is set to a low temperature. In order to solve the requirements of items (4) and (5), it is effective to use a steel having low contents of S and P and containing B, and to form fine ferrite particles by the selection of proper hot rolling condition. Based on the above described discoveries, the inventors have accomplished the present invention.

SUMMARY OF THE INVENTION

The first aspect of the present invention lies in a hot rolled steel sheet having high resistance against secondary-work embrittlement and adapted for ultra-deep drawing, which has a composition consisting of

| | |
|---|---|
| C: | not more than 0.0040%, |
| Mn: | not more than 0.20%, |
| Ti: | $\left[\left\{\frac{48}{14}N(\%)+\frac{48}{32}S(\%)+0.003\right\}\text{ to }\left\{3\times\frac{48}{12}C(\%)+\frac{48}{14}N(\%)+\frac{48}{32}S(\%)\right\}\right]\%$, |
| B: | 0.0002–0.0015%, |
| Al: | 0.005–0.10%, |
| N: | not more than 0.0040%, |
| P: | not more than 0.015%, |
| S: | not more than 0.0035%, and |
| | the remainder being substantially Fe. |

The second aspect of the present invention lies in a hot rolled steel sheet having high resistances against secondary-work embrittlement and brazing embrittlement and adapted for ultra-deep drawing, which has a composition consisting of

| | |
|---|---|
| C: | not more than 0.0040%, |
| Mn: | not more than 0.020%, |
| Ti: | $\left[\left\{\frac{48}{14}N(\%)+\frac{48}{32}S(\%)+0.003\right\}\text{ to }\left\{3\times\frac{48}{12}C(\%)+\frac{48}{14}N(\%)+\frac{48}{32}S(\%)\right\}\right]\%$, |
| B: | 0.0002–0.0020%, |
| Al: | 0.005–0.10%, |
| N: | not more than 0.0040%, |
| P: | not more than 0.015%, |
| S: | not more than 0.0035%, and |
| | the remainder being substantially Fe, |

and consists substantially of ferrite having a grain size of not larger than 35 μm over the entire range in the sheet thickness direction.

The third aspect of the present invention lies in a method for producing a hot rolled steel sheet having high resistances against secondary-work embrittlement and brazing embrittlement and adapted for ultra-deep drawing, comprising heating a slab having the following composition up to a temperature of 1,000°–1,280° C., hot rolling the above heated slab at a finishing hot rolling temperature of 880°–920° C., starting the cooling of the finishing hot-rolled sheet within one second after completion of the finishing hot rolling, cooling continuously the sheet at a cooling rate of 10° C./sec or higher, and coiling the cooled steel sheet at a temperature within the range of 550°–480° C., said composition consisting of

| | |
|---|---|
| C: | not more than 0.0040%, |
| Mn: | not more than 0.020%, |

-continued

| | |
|---|---|
| Ti: | $\left[\left\{\frac{48}{14}N(\%)+\frac{48}{32}S(\%)+0.003\right\}\text{ to }\left\{3\times\frac{48}{12}C(\%)+\frac{48}{14}N(\%)+\frac{48}{32}S(\%)\right\}\right]\%$, |
| B: | 0.0002–0.0020%, |
| Al: | 0.005–0.10%, |
| N: | not more than 0.0040%, |
| P: | not more than 0.015%, |
| S: | not more than 0.0035%, and |
| | the remainder being substantially Fe. |

DESCRIPTION OF THE PREFERRED EMBODIMENT

Figure 1:
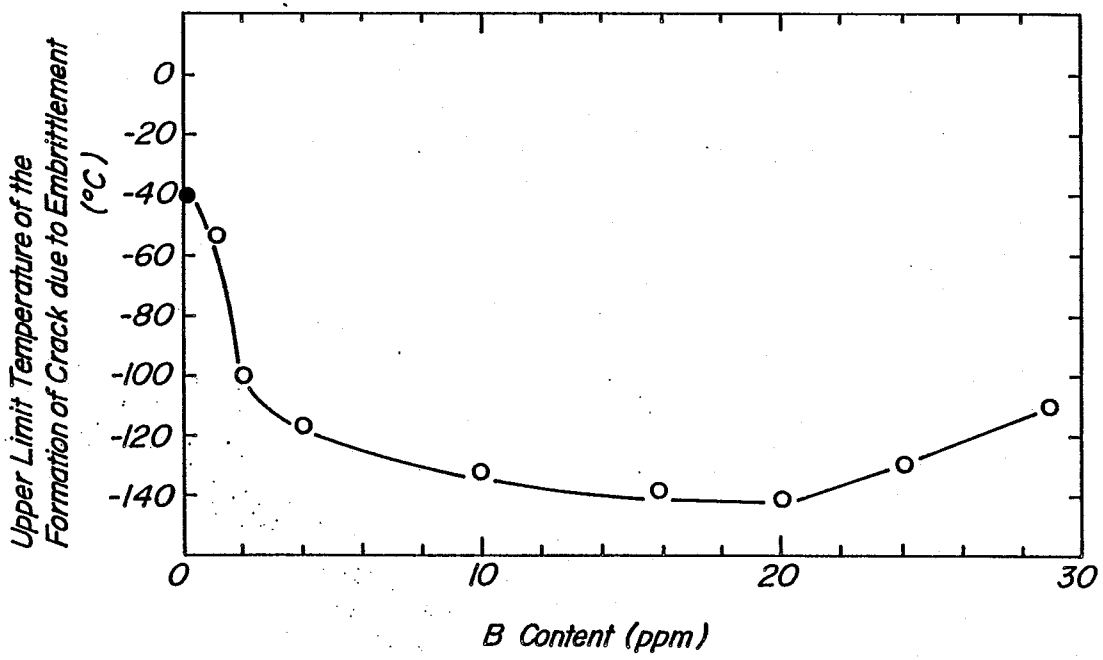
FIG. 1 is a graph illustrating the influence of the B content in a hot rolled steel sheet upon its upper limit temperature of the formation of crack due to the embrittlement of the steel sheet.

First, an explanation will be made with respect to the first aspect of the present invention. The reason why the composition of the hot rolled steel sheet in the first aspect of the present invention is limited within the above described range, is as follows.

C: It is desirable to use an ultra-low C steel having a C content of lower than 0.01% in order to produce a hot rolled steel sheet having improved workability. However, it is rather necessary to leave a proper amount of 2–10 ppm of solute C in a steel in order to give a high resistance against secondary-work embrittlement to a hot rolled steel sheet.

This C content has a relation to the Ti and S contents in a steel as described later. When C content is high and Ti content is low, C is apt to remain in a steel in the form of solute C in an amount larger than the necessary amount of 10 ppm, and hence the resulting hot rolled steel sheet is poor not only in the ageing resistance, but also in the ductility, that is, in the deep drawability. When C content is high and Ti content is high corresponding to the high C content, a large amount of carbide (TiC) is formed and precipitated in the hot rolled steel sheet to harden the sheet, and the resulting hot rolled steel sheet is poor in the ductility, particularly in the uniform elongation.

Therefore, the lower content of C is the more preferable, and the upper limit of C content should be 0.0040%, and a preferable C content is not higher than 35 ppm in the hot rolled steel sheet of the first aspect of the present invention.

Mn: A steel sheet containing a large amount of Mn is poor in the workability, and therefore the upper limit of the Mn content is limited to 0.20%. Although a small amount of Mn (for example, about 0.10%) has been added to steel in order to prevent its red shortness, the hot rolled steel sheet of the first aspect of the present invention has a low S content and contains Ti, and hence the steel sheet is substantially free from the red shortness. Accordingly, a steel containing substantially no Mn can be used. However, the upper limit of the Mn content in the steel sheet of the first aspect of the present invention is limited to 0.20% based on the above described reason.

Ti: Ti is the most important element constituting the hot rolled steel sheet of the present invention and constituting the slab to be used for the production of the hot rolled steel sheet. The hot rolled steel sheet of the first aspect of the present invention must contain Ti in an amount of at least [(48/14)N(%)+(48/32)S(%)+0.003]% in order to fix a part of each of S, N and C in the steel sheet and to improve the workability of the steel sheet. The amount of (48/14)N(%) or (48/32)S(%) corresponds to the amount of Ti necessary to fix N or S, respectively. The reason why the lower limit of the Ti content is limited to [(48/14)N(%)+(48/32)S(%)+0.003]% is that a part of C contained in the steel is fixed in the form of TiC and a proper amount of C is left in the steel in the form of solute C, whereby the resistance against secondary-work embrittlement of the steel sheet is improved without deteriorating its ageing resistance.

When the Ti content in a steel sheet is lower than this low limit value, C and N are solid solved in the steel, and the ageing resistance of the steel sheet is noticeably deteriorated inspite of the fact that the resistance against secondary-work embrittlement of the steel sheet is improved.

While, even when a fairly large amount of Ti is contained in the hot rolled steel sheet of the first aspect of the present invention within the range of not larger than [3×(48/12)C(%)+(48/14)N(%)+(48/32)S(%)]%, a proper amount of solute C remains in the steel sheet due to the presence of a very small amount of S, and additional Ti acts to fix P, which is harmful for embrittlement, in the form of TiP, and to fix S in the form of TiS. Therefore, the steel sheet has high resistance against secondary-work embrittlement.

The reason why the upper limit of Ti is limited to [3×(48/12)C(%)+(48/14)N(%)+(48/32)S(%)]% is that, when the amount of Ti exceeds this value, the total amount of C is fixed in the form of TiC not to leave solute C, and the resistance against secondary-work embrittlement of the steel sheet is deteriorated and further the workability of the steel sheet is deteriorated due to the hardening of the steel sheet by the solute Ti.

B: In the first aspect of the present invention, B is contained in a hot rolled steel sheet in order to improve predominantly the resistance against secondary-work embrittlement of the steel sheet as described above. Moreover, the addition of B to the steel sheet has such effects that, when the steel sheet is heated in the welding step and the like carried out after the press working, B suppresses the growth of coarse grains in the region influenced by the heat and prevents the deterioration of the tensile strength and fatigue strength of the steel sheet at the joint.

In order to ascertain the effect of B, the following simulation hot rolling experiments were carried out by the use of molten steels having different B contents and produced under vacuum, and the following test for the resistance against secondary-work embrittlement of the resulting hot rolled steel sheets was effected.

Slabs were produced on a laboratory scale from molten steels, which were produced under vacuum and had compositions containing C: 0.0025%, Si: 0.01%, Mn: 0.11%, Ti: 0.026%, Al: 0.035%, N: 0.0030%, P: 0.009% and S: 0.002% as basic components, and further containing different amounts of B. Each of the slabs was hot rolled under a condition of heating temperature: 1,250° C., finishing hot rolling temperature: 900° C., coiling temperature: 540° C., and cooling rate of a continuous cooling of the hot rolled sheet carried out just after completion of the finishing hot rolling: 20° C./sec (from the finishing-hot rolled sheet temperature to the temperature at the end of water cooling), to produce a hot rolled steel sheet having a thickness of 3.2 mm, and the resulting hot rolled steel sheet was pickled and then subjected to the following test for the resistance against secondary-work embrittlement.

Test for resistance against secondary-work embrittlement

A hot rolled steel sheet sample was punched to produce a disc of 100 mmϕ, the disc was deep drawn by means of a cylindrical punch of 50 mmϕ. The resulting cup was kept to a given test temperature, and then a weight of 5 kg was dropped from a height of 1.0 m on the above treated cup and was collided thereto, and whether or not crack was formed in the cup due to the embrittlement of the steel was observed.

The results of the test are shown in Table 1. It can be seen from Table 1 that the upper limit temperature in the formation of crack due to the embrittlement of the steel sheet lowers with the increase of the B content.

The effect of B contained in a hot rolled steel sheet to decrease the embrittlement temperature of the steel sheet appears significantly when the B content is 2 ppm or higher, and the embrittlement temperature of the steel sheet becomes stable in a low temperature range when the B content is 10 ppm or higher. However, when the B content exceeds 20 ppm, the embrittlement temperature of the steel sheet rather increases.

While, it is known that a hot rolled steel sheet containing a large amount of B has high resistance against secondary-work embrittlement even in the absence of solute C. However, B suppresses the development of recrystallization grain of austenite during the hot rolling, develops easily a peculiar recrystallization texture, and causes a large anisotropy. Therefore, the upper limit of the B content in the hot rolled steel sheet of the first aspect of the present invention is limited to 15 ppm. The most preferable B content in the steel sheet lies within the range of B: 0.0004–0.0010%. When a proper amount of solute C is left in a hot rolled steel sheet having the above described B content, the hot rolled steel sheet containing B and solute C has more improved resistance against secondary-work embrittlement even in the region influenced by heat without the increase of anisotropy, as compared with conventional steel sheet.

The B content in the hot rolled steel sheet of the first aspect of the present invention is limited to 2–15 ppm based on the above described reason.

Al: At least 0.005% of Al is necessary in order to fix O in a steel and to keep highly and stably the yield of Ti. The use of more than 0.10% of Al results in a high production cost of a hot rolled steel sheet and further results in the saturation of the effect and in the increase of the risk of formation of surface defects.

P: P has a very high solid solution hardening ability and deteriorates the workability of steel, and further is apt to segregate in the grain boundary to promote the embrittlement of steel. Therefore, the P content in the hot rolled steel sheet of the first aspect of the present invention is limited to not more than 0.015%.

N: N is fixed in the form of TiN by Ti at a high temperature range (during the slab heating or rough rolling at 1,000° C. or higher) or is fixed in the form of AlN, and hence the adverse influence by the solute N is not so high. However, a steel containing a large amount of N is low in the ductility, and further is required to contain a large amount of Ti in view of the ageing resistance. Therefore, the N content in the hot rolled steel sheet of the first aspect of the present invention is limited to not higher than 0.0040%, preferably not higher than 0.0035%.

S: S is one of the most important elements as well as Ti in the hot rolled steel sheet of the present invention.

Major part of S is fixed in the form of TiS in a high temperature range (at least about 1,000° C.) during the solidification of slab or during the heating or hot rolling of slab. Ti fixes solute S to prevent the segregation of S in the grain boundary and to prevent the decrease of the grain boundary strength. Therefore, Ti is effective for improving the resistance against secondary-work embrittlement of steel sheet. However, it is known that the resulting TiS acts as a nucleus in the case where C contained in the steel is precipitated and fixed mainly in the form of TiC. Therefore, in an ultra-low S steel sheet having an S content of not more than 0.0035%, although the amount of TiS is small, the number of the precipitation sites of TiC is small corresponding to the small amount of TiS, and hence solute C remains easily in the steel sheet, and a proper amount of about 2–10 ppm of solute C remains in the steel sheet. This solute C is segregated in the grain boundary to enhance remarkably the grain boundary strength and to improve the resistance against secondary-work embrittlement of the steel sheet.

However, when the S content is as large as more than 0.005% as in the conventional steel sheet, the above described effect does not appear. Accordingly, the S content in the hot rolled steel sheet of the first aspect of the present invention is limited to not more than 0.0035%.

The production method of the hot rolled steel sheet of the first aspect of the present invention is as follows.

A steel having the above described composition is subjected to a conventional treatment to produce a hot rolled steel sheet. That is, in the ordinary method, a molten steel produced in a converter is subjected to a degassing treatment and then to a continuous casting to produce a slab. In the present invention, any processes can be used in the production of a slab from the molten steel without adverse influence upon the effect of the present invention. Therefore, for example, even when a sheet bar having a thickness of about 30 mm is cast, the same effect can be expected. In the hot rolling, a method, wherein a slab is again heated, the heated slab is subjected to a rough hot rolling and then to a finishing hot rolling, and the finishing hot-rolled sheet is coiled, is ordinarily carried out. In the present invention also, this ordinary method is carried out. Further, in the present invention, even when a CC-DR, that is, a direct rolling of slab, is carried out, the same effect as in the ordinary method can be expected. The resulting hot rolled steel sheet is occasionally subjected to a levelling treatment or to a descaling treatment to obtain a final product. Moreover, when a surface treatment of the hot rolled steel sheet, such as hot dipping in Zn or the like, is carried out, a plated sheet having high resistance against secondary-work embrittlement and high ultra-deep drawability same as those of the hot rolled steel sheet as such can be obtained.

The second and third aspects of the present invention will be explained hereinafter.

One of the features of the hot rolled steel sheet having high resistances against secondary-work embrittlement and brazing embrittlement and adapted for ultra-deep drawing of the second and third aspects of the present invention lies in that the steel sheet consists substantially of ferrite having a grain size of not larger than 35 μm over the entire range in the sheet thickness direction.

An explanation will be made with respect to the reason of the limitation of the amount of components of the hot rolled steel sheet of the second and third aspects of the present invention and to the reason of the limitation of the hot rolling condition in the production of the steel sheet.

The reason of the limitation of the amounts of C, Mn, Ti, Al, N, P and S is the same as that explained in the first aspect of the present invention.

The reason of the limitation of the B content in the hot rolled steel sheet of the second and third aspects of the present invention is as follows.

B: In the second and third aspects of the present invention, B is contained in the hot rolled steel sheet in order to improve predominantly the resistances against secondary-work embrittlement and brazing embrittlement as described above. Moreover, the addition of B to the steel sheet has such effects that, when the steel sheet is heated in the welding step and the like carried out after the press working, B suppresses the growth of coarse grains in the region influenced by the heat and prevents the deterioration of the tensile strength and fatigue strength of the steel sheet at the joint as hereinbefore explained.

In order to ascertain the effect of B, the following tests were carried out, by the use of the same hot rolled steel sheet as that used in the explanation of the influence of B content in the steel sheet of the first aspect of the present invention, with respect to the resistances against secondary-work embrittlement and brazing embrittlement and to the spot weldability relating to the growth of coarse grains in the region influenced by the heat.

(1) Resistance against secondary-work embrittlement:

The same test for the resistance against secondary-work embrittlement as the test described in the explanation of the first aspect of the present invention is carried out. The obtained results are the same as those illustrated in Table 1, that is, the upper limit temperature in the formation of crack due to the embrittlement lowers with the increase of the B content.

The effect of B contained in a hot rolled steel sheet to decrease the embrittlement temperature of the steel sheet appears significantly when the B content is 2 ppm or higher, and the embrittlement temperature of the steel sheet becomes stable in a low temperature range when the B content is 10 ppm or higher. However, when the B content exceeds 20 ppm, the embrittlement temperature of the steel sheet rather increases.

While, it known that a hot rolled steel sheet containing a large amount of B has high resistance against secondary-work embrittlement regardless of the presence or absence of solute C. However, a hot rolled steel sheet containing a large amount of B has a large anisotropy. However, the hot rolled steel sheet of the second aspect of the present invention consists substantially of ferrite having a grain size of not larger than 35 μm over an entire range in the sheet thickness direction, and therefore when the B content in the steel sheet is 20 ppm or less, the steel sheet has high resistance against secondary-work embrittlement without having a large anisotropy.

(2) Resistance against brazing embrittlement:

The above described hot rolled steel sheet was worked into a JIS No. 13 tensile test piece. A 2 mm V notch was formed on the center of the parallel portion of the test piece, and the test piece was heated to a given temperature, and a silver solder itself was brazed to the notch portion under a load of a certain stress. After a lapse of certain period of time (10 seconds), whether the test piece was broken or not due to the embrittlement of the steel was observed.

It has been found from the above described experiment that a hot rolled steel sheet containing at least 2 ppm of B has a critical tensile stress at break about 2 $kgf/mm^2$ higher than that of a hot rolled steel sheet containing no B, and this effect is substantially constant until the B content in the steel sheet is up to about 30 ppm. Then, each of a deep drawn sample containing 2 ppm of B and that containing no B was subjected to a hole expansion, and a silver solder itself was brazed to the shear plane. In this experiment, in the deep drawn sample containing no B, there occurred such trouble that the silver solder was penetrated into the steel along the grain boundary to form cracks in the steel. On the contrary, in the deep drawn sample containing 2 ppm of B, such trouble did not occur.

(3) Spot weldability:

A spot welding of the hot rolled steel sheet was effected under the A class condition described in the Resistance Welding Manual published by Resistance Welder Manufacture's Association in U.S.A., and the microstructures of the nugget, HAZ and matrix were examined. It has been found that, in the steel sheet containing no B, ferrite grains of HAZ are extraordinarily grown up (>0.5 mm) and the strength in the welded portion is not high enough to satisfy the strength of a welded joint. On the contrary, in the steel sheet containing B, such extraordinary grain growth does not occur, and the joint strength is high. This effect is saturated in a B content of about 15 ppm, and even when a steel sheet contains more than 15 ppm of B, the joint strength of the steel sheet is not lowered. Based on the results of the above described experiment, the B content in the hot rolled steel sheet in the second and third aspects of the present invention is limited to 2–20 ppm.

A method for producing the hot rolled steel sheet of the second aspect of the present invention will be explained hereinafter.

The hot rolled steel sheet having the above described composition can be produced according to the method already explained relating to the hot rolled steel sheet of the first aspect of the present invention. Further, when a surface treatment of the hot rolled steel sheet, such as hot dipping in Zn or the like, is carried out, a plated sheet having high resistances against secondary-work embrittlement and brazing embrittlement and high ultra-deep drawability same as those of the hot rolled steel sheet as such can be obtained.

Figure 2:
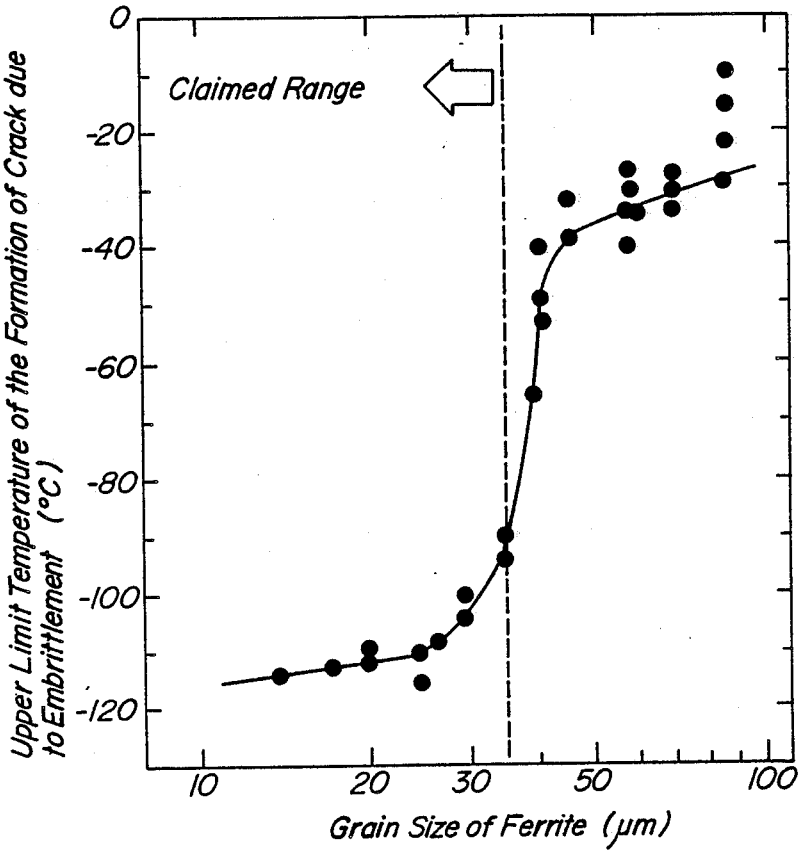
FIG. 2 is a graph illustrating the influence of the grain size of ferrite in the hot rolled steel sheet upon the resistance against secondary-work embrittlement of the steel sheet.

However, in the hot rolled steel sheet of the second aspect of the present invention, it is necessary that the steel sheet consists substantially of ferrite having a grain size of not larger than 35 μm over the entire range in the sheet thickness direction. FIG. 2 illustrates the influence of the grain size of ferrite constituting a steel sheet upon the resistance against secondary-work embrittlement of the steel sheet. It can be seen from FIG. 2 that, when the grain size of ferrite exceeds 35 μm, the unit of fracture surface becomes extraordinarily large in the above described test for the resistance against secondary-work embrittlement, and the steel sheet becomes brittle. Moreover, in the brazing, the braze is very easily penetrated into the ferrite grain boundary to increase the probability of the formation of crack.

In the production of the above described hot rolled steel sheet of the second aspect of the present invention, the hot rolling condition is important. This hot rolling condition is the third aspect of the present invention, and will be explained hereinafter.

First, it is necessary that a slab is heated to a temperature of 1,000°–1,280° C. When the heating temperature is lower than 1,000° C., it is impossible to maintain surely the finishing hot rolling temperature, and further the rolling load becomes excessively high. Therefore, the heating temperature of lower than 1,000° C. of slab is not preferable in view of the rolling operation. When the heating temperature of slab exceeds 1,280° C., AlN, TiS and a part of TiN are dissolved, and the initial stage γ grains are extraordinarily grown up, and a uniform microstructure having finally a small grain size of not larger than 35 μm cannot be obtained.

The finishing hot rolling temperature must be within the range of 880°–920° C. When the finishing hot rolling temperature is lower than 880° C., the temperature of the steel sheet is too low at the surface layer and at the end portion of the sheet width, and elongated recovered ferrite grains are formed in the steel sheet. As the result, although the deterioration of the ductility is small, the hot rolled steel sheet has a large anisotropy and is not suitable to be subjected to a deep drawing.

In the cooling step following the hot rolling, the time from the completion of the finishing hot rolling to the starting of the cooling operation, and the cooling rate are important. When the time from the completion of the finishing hot rolling to the starting of the cooling operation is longer than one second, coarse ferrite grains are formed in the steel sheet due to the reason that the extraordinary grain growth occurs in a steel having a composition defined in the present invention, and the resulting hot rolled steel sheet is poor in the resistance against secondary-work embrittlement.

When the cooling rate is lower than 10° C./sec, the hot rolled steel sheet is poor in the resistance against secondary-work embrittlement due to the same reason as described above. Any cooling methods can be used in order to cool the finishing hot-rolled sheet to a temperature near the coiling temperature at a cooling rate of 10° C./sec or higher, but water cooling is generally used.

Accordingly, it is necessary that the cooling of the hot rolled steel sheet is started within one second after completion of the finishing hot rolling, and the steel sheet is continuously cooled at a cooling rate of 10° C./sec or higher to the temperature at the end of the accelerated cooling.

It is necessary that the hot rolled steel sheet is coiled at a temperature of 550°–480° C. The lower coiling temperature is the more advantageous for obtaining small grain size, and a coiling temperature of not higher than 550° C. can form grains having a size of not larger than 35 μm. However, when the coiling temperature is lower than 480° C., the recrystallization texture of the steel sheet is disordered, and an excessively hard steel sheet is formed. Therefore, a coiling temperature of not lower than 480° C. is necessary.

The following examples are given for the purpose of illustration of this invention and are not intended as limitations thereof.

EXAMPLE 1

A molten steel having a composition shown in the following Table 1 was produced in a converter, and the molten steel was subjected to an RH degassing treatment and then to a continuous casting to produce a slab. The slab, after heated up to 1,250° C., was hot rolled at a finishing hot rolling temperature of 920° C.±5° C. and coiled at a temperature of 570° C. to produce a hot rolled steel sheet having a thickness of 3.2 mm.

After removal of scale, the mechanical properties and the resistance against secondary-work embrittlement of the resulting hot rolled steel sheet were tested. As the measure of the strain-ageing resistance, the ageing index (AI) was used. When the ageing index of a steel sheet is 3 kgf/mm$^2$ or less, the progress of strain ageing in the steel sheet is very slow at room temperature, and the steel sheet is substantially non-ageing. The resistance against secondary-work embrittlement of the hot rolled steel sheet was tested in the following manner. A steel sheet sample was punched to produce a disc of 100 mmϕ, and the disc was subjected to a deep drawing in a draw ratio of 2.0 by means of a punch having a plane bottom of 50 mmϕ. The resulting cup was then subjected to a heat treatment, wherein the cup was rapidly heated up to 600° C. at a heating rate of 5° C./sec, kept at this temperature for 60 seconds and then cooled in air. The heat treated cup was cooled to −50° C., and a weight of 5 kg was dropped from a height of 1 m on the cooled cup, and whether or not a crack was formed in the cup was observed. The resistance against secondary-work embrittlement of the steel sheet sample was evaluated by the presence or absence of crack in the cup.

The obtained results are shown in the following Table 2. In Table 2, $\overline{YS}$, $\overline{TS}$ or $\overline{El}$ is defined by the average value of YS, TS or El in the rolling direction, YS, TS or El in a direction perpendicular to the rolling direction, and YS, TS or El in a direction inclined at an angle of 45° with respect to the rolling direction, respectively. For example, the ductility $\overline{El}$ is represented by $(El_0+El_{90}+2El_{45})/4$. In the formula, the suffix 0, 90 or 45 represents an angle between the rolling direction and the test piece.

The planar anisotropy ΔEl was evaluated by $(El_0+El_{90}-2El_{45})/2$.

TABLE 1

| Sample No. | (in wt %) C | Si | Mn | P | S | Al | N | B | Ti | $X_1$*1 | $X_2$*1 | Remarks |
|---|---|---|---|---|---|---|---|---|---|---|---|---|
| 1-1 | 0.0043* | <0.01 | 0.11 | 0.009 | 0.0021 | 0.029 | 0.0024 | 0.0006 | 0.025 | 0.0114 | 0.063 | |
| 1-2 | 0.0025 | 0.01 | 0.28* | 0.010 | 0.0029 | 0.045 | 0.0019 | 0.0010 | 0.031 | 0.0108 | 0.041 | |
| 1-3 | 0.0028 | 0.01 | 0.15 | 0.018* | 0.0019 | 0.051 | 0.0028 | 0.0005 | 0.020 | 0.0124 | 0.046 | |
| 1-4 | 0.0020 | 0.02 | 0.10 | 0.010 | 0.0026 | 0.037 | 0.0030 | 0.0008 | 0.024 | 0.0141 | 0.038 | Present invention |
| 1-5 | 0.0037 | 0.01 | 0.08 | 0.011 | 0.0025 | 0.041 | 0.0021 | 0.0013 | 0.029 | 0.0109 | 0.055 | Present invention |
| 1-6 | 0.0019 | 0.02 | 0.10 | 0.010 | 0.0031 | 0.040 | 0.0029 | 0.0005 | 0.022 | 0.0145 | 0.037 | Present invention |
| 1-7 | 0.0022 | 0.01 | 0.13 | 0.010 | 0.0037* | 0.042 | 0.0031 | 0.0006 | 0.030 | 0.0161 | 0.043 | |
| 1-8 | 0.0021 | 0.03 | 0.09 | 0.009 | 0.0030 | 0.067 | 0.0028 | 0.0010 | 0.026 | 0.0141 | 0.039 | Present invention |
| 1-9 | 0.0018 | <0.01 | 0.13 | 0.009 | 0.0028 | 0.029 | 0.0042* | 0.0006 | 0.024 | 0.0186 | 0.040 | |
| 1-10 | 0.0020 | 0.02 | 0.11 | 0.010 | 0.0029 | 0.028 | 0.0028 | 0.0008 | 0.012* | 0.0139 | 0.038 | |
| 1-11 | 0.0023 | 0.01 | 0.09 | 0.011 | 0.0016 | 0.031 | 0.0026 | 0.0007 | 0.040* | 0.0113 | 0.039 | |
| 1-12 | 0.0020 | 0.01 | 0.10 | 0.010 | 0.0030 | 0.041 | 0.0029 | 0.0001* | 0.030 | 0.0144 | 0.038 | |
| 1-13 | 0.0026 | 0.02 | 0.09 | 0.009 | 0.0026 | 0.050 | 0.0028 | 0.0016* | 0.021 | 0.0135 | 0.045 | |
| 1-14 | 0.0011 | 0.01 | 0.12 | 0.007 | 0.0021 | 0.018 | 0.0025 | 0.0009 | 0.019 | 0.0147 | 0.025 | Present invention |
| 1-15 | 0.0023 | 0.02 | 0.09 | 0.010 | 0.0025 | 0.033 | 0.0029 | 0.0002 | 0.023 | 0.0167 | 0.041 | Present invention |
| 1-16 | 0.0026 | 0.01 | 0.10 | 0.009 | 0.0017 | 0.041 | 0.0026 | <0.0001* | 0.025 | 0.0145 | 0.043 | |
| 1-17 | 0.0022 | 0.01 | 0.11 | 0.009 | 0.0029 | 0.005 | 0.0023 | 0.0008 | 0.031 | 0.0152 | 0.039 | Present invention |
| 1-18 | 0.0020 | 0.02 | 0.10 | 0.011 | 0.0030 | 0.010 | 0.0030 | 0.0010 | 0.024 | 0.0179 | 0.039 | Present invention |

Note:
*outside the scope of the present invention

*1 $x_1 = \frac{48}{14}N(\%) + \frac{48}{32}S(\%) + 0.003$, $x_2 = 3 \times \frac{48}{12}C(\%) + \frac{48}{14}N(\%) + \frac{48}{32}S(\%)$

TABLE 2

| Sample No. | $\overline{YS}$ (kgf/mm$^2$) | $\overline{TS}$ (kgf/mm$^2$) | $\overline{El}$ (%) | ΔEl (%) | AI (kgf/mm$^2$) | Resistance*2 against secondary-work embrittlement | Remarks |
|---|---|---|---|---|---|---|---|
| 1-1 | 21.9 | 34.1 | 46.5 | −1.3 | 2.8 | O | |
| 1-2 | 20.1 | 32.8 | 47.9 | −0.8 | 2.7 | O | |
| 1-3 | 21.2 | 32.6 | 46.9 | −0.7 | 2.9 | O | |
| 1-4 | 18.2 | 30.9 | 55.0 | −1.2 | 2.8 | O | Present invention |
| 1-5 | 18.8 | 31.2 | 55.1 | −2.8 | 2.5 | O | Present invention |
| 1-6 | 17.2 | 29.8 | 57.1 | −1.9 | 2.1 | O | Present invention |
| 1-7 | 18.2 | 30.5 | 55.2 | −2.0 | 0.9 | X | |
| 1-8 | 18.5 | 30.4 | 54.8 | −2.2 | 3.0 | O | Present invention |
| 1-9 | 19.9 | 32.0 | 50.7 | −1.8 | 2.6 | O | |
| 1-10 | 16.5 | 29.5 | 55.3 | −2.2 | 4.2 | O | |
| 1-11 | 17.8 | 29.6 | 55.0 | −2.0 | 1.1 | X | |
| 1-12 | 18.1 | 30.2 | 55.3 | −1.7 | 2.8 | X | |
| 1-13 | 17.9 | 30.2 | 54.7 | −3.5 | 2.7 | O | |
| 1-14 | 16.9 | 29.2 | 57.3 | −2.0 | 3.0 | O | Present |

TABLE 2-continued

| Sample No. | $\overline{YS}$ (kgf/mm²) | $\overline{TS}$ (kgf/mm²) | $\overline{El}$ (%) | ΔEl (%) | AI (kgf/mm²) | Resistance*2 against secondary-work embrittlement | Remarks |
|---|---|---|---|---|---|---|---|
| | | | | | | | invention |
| 1-15 | 18.3 | 30.2 | 55.3 | −1.3 | 2.8 | O | Present invention |
| 1-16 | 19.2 | 31.2 | 55.4 | −0.9 | 2.7 | X | |
| 1-17 | 19.8 | 30.7 | 55.0 | −1.8 | 2.9 | O | Present invention |
| 1-18 | 18.8 | 29.9 | 56.1 | −2.1 | 2.5 | O | Present invention |

Note:
*2O no cracks, X cracks

The hot rolled steel sheets of Sample Nos. 1-1, 1-2 and 1-3 have C, Mn and P contents outside the range defined in the present invention respectively, and are poor in the mechanical property.

The hot rolled steel sheet of Sample No. 1-7 has an S content outside the range defined in the present invention, and is poor in the resistance against secondary-work embrittlement.

The hot rolled steel sheet of Sample No. 1-9 has an N content outside the range defined in the present invention, and is poor in the mechanical property.

The hot rolled steel sheet of Sample No. 1-10 has a Ti content lower than the lower limit of Ti content defined in the present invention, and is poor in the strain-ageing resistance. The hot rolled steel sheet of Sample No. 1-11 has a Ti content higher than the upper limit of Ti content defined in the present invention, and is poor in the resistance against secondary-work embrittlement.

The hot rolled steel sheets of Sample Nos. 1-12 and 1-16 have a B content lower than the lower limit of B content defined in the present invention, and are poor in the resistance against secondary-work embrittlement. The hot rolled steel sheet of Sample No. 1-13 has a B content higher than the upper limit of B content defined in the present invention, and has a very large anisotropy.

The hot rolled steel sheets of Sample No. 1-4, 1-5, 1-6, 1-8, 1-14, 1-15, 1-17 and 1-18 are ones of the present invention, and have excellent mechanical property and high resistance against secondary-work embrittlement and further have a small anisotropy.

EXAMPLE 2

Molten steels having various compositions shown in the following Table 3 were produced in a converter, and each of the molten steels was subjected to a DH degassing treatment and then to a continuous casting to produce a slab. The slab was heated up to 1,250° C., and then hot rolled at a finishing hot rolling temperature of 900° C.±5° C. A water cooling of the finishing hot-rolled sheet was started 0.5 second after completion of the finishing hot rolling, and the sheet was cooled at a cooling rate of 15° C./sec and then coiled at 520° C. The coiled steel sheet had a uniform thickness of 2.6 mm.

After removal of scale, the steel sheet was tested with respect to the mechanical property, and to the resistances against strain ageing, secondary-work embrittlement and brazing embrittlement. The obtained results are shown in the following Table 4.

The test methods of the resistances against strain ageing, secondary-work embrittlement and brazing embrittlement are the same as described hereinbefore.

TABLE 3

| Sample No. | (in wt %) C | Si | Mn | P | S | Al | N | B | Ti | $X_1$*1 | $X_2$*1 | Remarks |
|---|---|---|---|---|---|---|---|---|---|---|---|---|
| 2-1 | 0.0030 | 0.03 | 0.15 | 0.009 | 0.0021 | 0.028 | 0.0020 | 0.0010 | 0.025 | 0.013 | 0.046 | Present invention |
| 2-2 | 0.0048* | 0.01 | 0.15 | 0.010 | 0.0030 | 0.035 | 0.0025 | 0.0010 | 0.022 | 0.016 | 0.071 | |
| 2-3 | 0.0035 | <0.01 | 0.30* | 0.012 | 0.0032 | 0.040 | 0.0025 | 0.0010 | 0.025 | 0.016 | 0.055 | |
| 2-4 | 0.0020 | 0.03 | 0.10 | 0.020* | 0.0025 | 0.045 | 0.0025 | 0.0013 | 0.030 | 0.015 | 0.036 | |
| 2-5 | 0.0025 | 0.02 | 0.08 | 0.005 | 0.0038* | 0.060 | 0.0030 | 0.0007 | 0.035 | 0.019 | 0.046 | |
| 2-6 | 0.0030 | 0.02 | 0.15 | 0.007 | 0.0030 | 0.040 | 0.0045* | 0.0010 | 0.028 | 0.023 | 0.056 | |
| 2-7 | 0.0035 | 0.01 | 0.15 | 0.010 | 0.0025 | 0.038 | 0.0025 | <0.0001* | 0.025 | 0.015 | 0.054 | |
| 2-8 | 0.0028 | <0.01 | 0.12 | 0.010 | 0.0020 | 0.015 | 0.0030 | 0.0025* | 0.020 | 0.016 | 0.025 | |
| 2-9 | 0.0030 | 0.03 | 0.15 | 0.009 | 0.0025 | 0.035 | 0.0025 | 0.0018 | 0.010* | 0.015 | 0.048 | |
| 2-10 | 0.0025 | 0.04 | 0.09 | 0.010 | 0.0030 | 0.035 | 0.0030 | 0.0010 | 0.060* | 0.018 | 0.045 | |
| 2-11 | 0.0030 | 0.01 | 0.15 | 0.009 | 0.0030 | 0.030 | 0.0020 | 0.0005 | 0.020 | 0.014 | 0.047 | Present invention |
| 2-12 | 0.0020 | 0.02 | 0.15 | 0.004 | 0.0020 | 0.025 | 0.0020 | 0.0004 | 0.023 | 0.013 | 0.034 | Present invention |

Note:
*outside the scope of the present invention

*1 $x_1 = \frac{48}{14} N(\%) + \frac{48}{32} S(\%) + 0.003$, $x_2 = 3 \times \frac{48}{12} C(\%) + \frac{48}{14} N(\%) + \frac{48}{32} S(\%)$

TABLE 4

| Sample No. | $\overline{YS}$ (kgf/mm²) | $\overline{TS}$ (kgf/mm²) | $\overline{El}$ (%) | ΔEl | AI (kgf/mm²) | Average particle size of ferrite (μm) | Resistance*2 against secondary-work embrittlement | Resistance*2 against brazing embrittlement | Remarks |
|---|---|---|---|---|---|---|---|---|---|
| 2-1 | 17.5 | 30.0 | 57.1 | −1.0 | 2.5 | 25 | O | O | Present invention |
| 2-2 | 20.0 | 33.1 | 46.0 | −0.8 | 2.8 | 20 | O | O | |
| 2-3 | 21.0 | 33.0 | 45.0 | −0.8 | 3.0 | 20 | O | O | |

TABLE 4-continued

| Sample No. | $\overline{YS}$ (kgf/mm²) | $\overline{TS}$ (kgf/mm²) | $\overline{El}$ (%) | ΔEl | AI (kgf/mm²) | Average particle size of ferrite (μm) | Resistance*2 against secondary-work embrittlement | Resistance*2 against brazing embrittlement | Remarks |
|---|---|---|---|---|---|---|---|---|---|
| 2-4 | 21.2 | 32.0 | 47.0 | −2.0 | 2.5 | 25 | X | O | |
| 2-5 | 18.0 | 31.0 | 50.0 | −2.0 | 1.0 | 20 | X | O | |
| 2-6 | 19.5 | 32.0 | 44.0 | −1.9 | 3.0 | 20 | O | O | |
| 2-7 | 16.5 | 29.5 | 57.0 | −0.5 | 2.0 | 38* | X | X | |
| 2-8 | 20.0 | 32.0 | 47.0 | −3.0 | 2.5 | 22 | O | O | |
| 2-9 | 19.0 | 31.0 | 54.0 | −3.0 | 4.0 | 20 | O | O | |
| 2-10 | 17.5 | 30.5 | 56.0 | −1.5 | 0.5 | 18 | X | O | |
| 2-11 | 17.5 | 30.0 | 58.0 | −0.8 | 2.8 | 20 | O | O | Present invention |
| 2-12 | 16.0 | 29.5 | 59.5 | −0.8 | 2.9 | 24 | O | O | Present invention |

Note:
*outside the scope of the present invention
*2O no cracks, X cracks

It can be seen from Tables 3 and 4 that the hot rolled steel sheets of Sample Nos. 2-1, 2-11 and 2-12 according to the present invention have a low YS, a high El, a small anisotropy ΔEl of elongation and a proper AI, and consist of ferrite having a properly fine grain size, and have high resistances against secondary-work embrittlement and brazing embrittlement.

Then, the slab having the composition of the steel of Sample No. 2-1 shown in Table 3 was then hot rolled under various hot rolling conditions as illustrated in the following Table 5, and the mechanical property and the resistances against secondary-work embrittlement and brazing embrittlement were evaluated in the same manner as described above. The obtained results are shown in Table 5.

TABLE 5

| Sample No. | Heating temperature of slab (°C.) | Finishing hot rolling temperature (°C.) | Time until the starting of water cooling (sec) | (a) Cooling rate (°C./sec) | Coiling temperature (°C.) | Sheet thickness (mm) | Particle size of ferrite (μm) | Remarks |
|---|---|---|---|---|---|---|---|---|
| 2-A | 1,250 | 900 | 0.5 | 15 | 520 | 2.6 | 25 | Present invention |
| 2-B | 1,300* | 900 | 0.5 | 15 | 520 | 2.6 | 40* | |
| 2-C | 1,250 | 830* | 0.5 | 13 | 540 | 2.6 | 31 | |
| 2-D | 1,250 | 950* | 0.5 | 16 | 530 | 2.6 | 40* | |
| 2-E | 1,250 | 900 | 1.5* | 15 | 520 | 2.6 | 38* | |
| 2-F | 1,260 | 890 | 0.7 | 20 | 500 | 1.8 | 25 | Present invention |
| 2-G | 1,250 | 900 | 0.8 | 12 | 540 | 3.0 | 27 | Present invention |
| 2-H | 1,250 | 900 | 0.5 | 5* | 520 | 2.6 | 45* | |
| 2-I | 1,230 | 890 | 0.5 | 17 | 450* | 2.6 | 18 | |
| 2-J | 1,260 | 895 | 0.2 | 13 | 520 | 4.0 | 28 | Present invention |

| Sample No. | $\overline{YS}$ (kgf/mm²) | $\overline{TS}$ (kgf/mm²) | $\overline{El}$ (%) | (b) ΔEl | Resistance*2 against secondary-work embrittlement | Resistance*2 against brazing embrittlement | Remarks |
|---|---|---|---|---|---|---|---|
| 2-A | 17.5 | 30.0 | 57.1 | −1.0 | O | O | Present invention |
| 2-B | 17.0 | 30.0 | 58.0 | −1.0 | X | X | |
| 2-C | 17.8 | 31.0 | 55.0 | −3.5 | X | O | |
| 2-D | 17.2 | 30.8 | 58.0 | −0.8 | X | X | |
| 2-E | 16.8 | 29.5 | 58.0 | −0.8 | X | X | |
| 2-F | 18.5 | 31.0 | 54.0 | −0.8 | O | O | Present invention |
| 2-G | 16.5 | 29.4 | 59.0 | −0.5 | O | O | Present invention |
| 2-H | 17.0 | 29.5 | 57.0 | −1.0 | X | X | |
| 2-I | 24.0 | 34.0 | 45.0 | −0.5 | O | O | |
| 2-J | 17.5 | 31.0 | 58.5 | −1.0 | O | O | Present invention |

Note:
*outside the scope of the present invention
*2O no cracks, X cracks

It can be seen from Table 5 that, only when a slab is hot rolled under a proper hot rolling condition (Sample Nos. 2-A, 2-F, 2-G and 2-J), a hot rolled steel sheet having high resistances against secondary-work embrittlement and brazing embrittlement can be produced.

As described above, the present invention provides a hot rolled steel sheet having high resistances against secondary-work embrittlement and brazing embrittlement, which are demanded to the hot rolled steel sheet having an ultra-deep drawability to be used in the structural parts of automobile, such as compressor cover and the like, and further provides a method for producing stably a hot rolled steel sheet having high resistances against secondary-work embrittlement and brazing embrittlement and adapted to ultra-deep drawing.

What is claimed is:

1. A hot rolled steel sheet having high resistance against secondary-work embrittlement and adapted for ultra-deep drawing, which has a composition consisting, in % by weight, of C: not more than 0.0040%,
Mn: not more than 0.20%, $$\text{Ti: } \left[\left\{\frac{48}{14}\,\text{N}(\%) + \frac{48}{32}\,\text{S}(\%) + 0.003\right\} \text{to } \left\{3 \times \frac{48}{12}\,\text{C}(\%) + \frac{48}{14}\,\text{N}(\%) + \frac{48}{32}\,\text{S}(\%)\right\}\right]\%,$$

B: 0.0002–0.0015%,
Al: 0.005–0.10%,
N: not more than 0.0040%,
P: not more than 0.015%,
S: not more than 0.0035%, and the remainder being substantially Fe.

2. A hot rolled steel sheet having high resistances against secondary-work embrittlement and brazing embrittlement and adapted for ultra-deep drawing, which has a composition consisting, in % by weight, of C: not more than 0.0040%,
Mn: not more than 0.20%, $$\text{Ti: } \left[\left\{\frac{48}{14}\,\text{N}(\%) + \frac{48}{32}\,\text{S}(\%) + 0.003\right\} \text{to } \left\{3 \times \frac{48}{12}\,\text{C}(\%) + \frac{48}{14}\,\text{N}(\%) + \frac{48}{32}\,\text{S}(\%)\right\}\right]\%,$$

-continued

B: 0.0002–0.0020%,
Al: 0.005–0.10%,
N: not more than 0.0040%,
P: not more than 0.015%,
S: not more than 0.0035%, and the remainder being substantially Fe, and consists substantially of ferrite having a grain size of not larger than 35 μm over the entire range in the sheet thickness direction.

3. A method for producing a hot rolled steel sheet having high resistances against secondary-work embrittlement and brazing embrittlement and adapted for ultra-deep drawing, comprising heating a slab having the following composition up to a temperature of 1,000°–1,280° C., hot rolling the above heated slab at a finishing hot rolling temperature of 880°–920° C., starting the cooling of the finishing hot-rolled steel sheet within one second after completion of the finishing hot rolling, cooling continuously the sheet at a cooling rate of 10° C./sec or higher, and coiling the cooled steel sheet at a temperature within the range of 550°–480° C., said composition consisting, in % by weight, of C: not more than 0.0040%,
Mn: not more than 0.20%, $$\text{Ti: } \left[\left\{\frac{48}{14}\,\text{N}(\%) + \frac{48}{32}\,\text{S}(\%) + 0.003\right\} \text{to } \left\{3 \times \frac{48}{12}\,\text{C}(\%) + \frac{48}{14}\,\text{N}(\%) + \frac{48}{32}\,\text{S}(\%)\right\}\right]\%,$$

B: 0.0002–0.0020%,
Al: 0.005–0.10%,
N: not more than 0.0040%,
P: not more than 0.015%,
S: not more than 0.0035%, and the remainder being substantially Fe.

* * * * *